United States Patent [19]

Nakajima et al.

[11] Patent Number: 4,718,329

[45] Date of Patent: Jan. 12, 1988

[54] CONTROL SYSTEM FOR HYDRAULIC CIRCUIT

[75] Inventors: Kichio Nakajima; Kazuo Honma; Hiroaki Tokairin, all of Ibaraki, Japan

[73] Assignee: Hitachi Construction Machinery Co., Ltd., Tokyo, Japan

[21] Appl. No.: 825,603

[22] Filed: Feb. 3, 1986

[30] Foreign Application Priority Data

Feb. 4, 1985 [JP] Japan ..... 60-18570
Sep. 2, 1985 [JP] Japan ..... 60-191934
Sep. 2, 1985 [JP] Japan ..... 60-191935

[51] Int. Cl.[4] ..... F15B 11/08

[52] U.S. Cl. ..... 91/445; 91/448; 91/459; 91/461

[58] Field of Search ..... 91/433, 445, 448, 461, 91/459; 364/509, 510, 511

[56] References Cited

U.S. PATENT DOCUMENTS 4,240,327 12/1980 Held ..... 91/433 X
4,336,590 6/1982 Jacq et al. ..... 364/510 X
4,417,312 11/1983 Cronin et al. ..... 364/510
4,595,342 6/1986 Christlieb et al. ..... 364/510 X

OTHER PUBLICATIONS

European Patent Application EP-A-O 068 197 filed Jun. 1982.

*Primary Examiner*—Edward K. Look
*Attorney, Agent, or Firm*—Antonelli, Terry & Wands

[57] ABSTRACT

A control system for a hydraulic circuit having an on-off valve interposed between the control valve and the actuator for allowing and blocking a flow of hydraulic fluid therebetween in which the control valve and on-off valves are actuated and switched in accordance with an operation signal from an operation device. Pressure sensors are connected to hydraulic lines upstream and downstream of the on-off valves for detecting the pressures in these hydraulic lines, and control unit is operative to calculate, based on the pressures detected by the pressure sensors, a value which reduces the difference between thrusts applied to the actuator and output the calculated value to the control valve while the on-off valves are closed to thereby perform pressure matching control.

7 Claims, 8 Drawing Figures

CONTROL SYSTEM FOR HYDRAULIC CIRCUIT

BACKGROUND OF THE INVENTION

This invention relates to control systems for hydraulic circuits, and more particularly it is concerned with a control system for a hydraulic circuit having externally operated on-off valves interposed between the control valve and the actuator for allowing and blocking a flow of hydraulic fluid therebetween, in which the control valve and on-off valves are actuated and switched in accordance with an operation signal produced by an operation device to thereby control the speed of operation of the actuator in accordance with the flow rate of the hydraulic fluid flowing through the control valve.

In one type of hydraulic circuit in which the speed of operation of the actuator is controlled, externally operated on-off valves are mounted between the control valve and actuator, as disclosed in JP, A, No. 57-154505, for example.

The on-off valves of this type of hydraulic circuit are mounted to avoid a fall of the driven article which might otherwise occur due to damage to the piping of the circuit, etc. In one manner of operation of this type of hydraulic circuit, the control valve is operated after the on-off valves are opened, so that a hydraulic fluid is supplied from a fluid source to the actuator to accelerate the operation of the actuator. In this type of hydraulic circuit of the prior art, if the on-off valves are opened to bring an inlet port of each on-off valve into communication with its outlet port when there is a difference in pressure between the upstream and downstream of the valve, the hydraulic fluid would flow from the higher pressure side to the lower pressure side as soon as the valve is opened, thereby applying an impact of shock to the actuator. Thus, even if the control valve is actuated slowly to accelerate the load gradually by slowly increasing the speed of operation of the actuator, the load would vibrate due to its inertia and the spring effect of the hydraulic fluid in the piping of the circuit as the impact of shock is applied to the actuator.

SUMMARY OF THE INVENTION

This invention has been developed for the purpose of solving the aforesaid problem of the prior art. Accordingly, the invention has as its object the provision of a control system for a hydraulic circuit which is capable of minimizing an impact of shock produced when the externally operated on-off valves are switched from a closed position to an open position to thereby smoothly accelerate the load.

According to the invention, there is provided a control system for a hydraulic circuit having on-off valves interposed between a control valve and an actuator for allowing and blocking a flow of hydraulic fluid, therebetween, in which the control valve and on-off valves are actuated and switched in accordance with an operation signal from operation means, the control system comprising pressure sensor means connected to hydraulic lines upstream and downstream of the on-off valves for detecting pressures in these hydraulic lines, and control means operative to calculate, based on the pressures detected by the pressure sensor means, a value which reduces the difference between thrusts applied to the actuator and outputting the calculated value to the control valve while the on-off valves are closed to thereby effect pressure matching control.

DESCRIPTION OF THE PREFERRED EMBODIMENTS

Preferred embodiments of the invention will be described by referring to the accompanying drawings.

Figure 1:
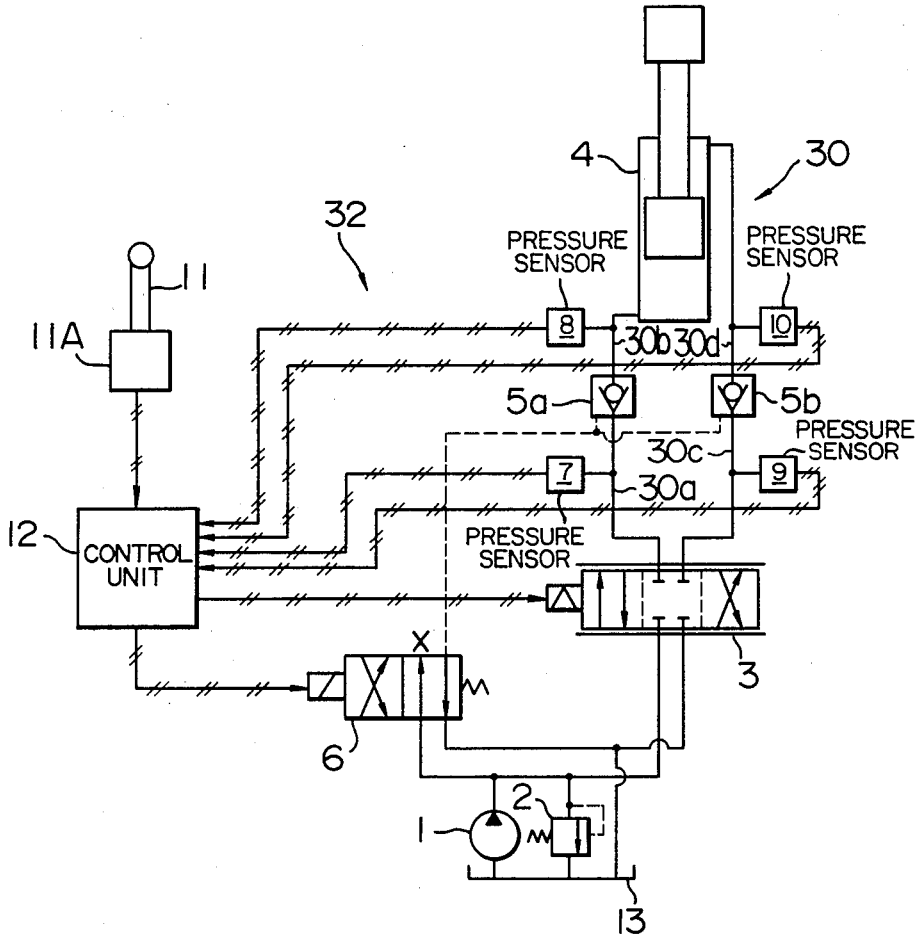
FIG. 1 is a circuit diagram of a control system for a hydraulic circuit in which one embodiment of the invention is incorporated.

FIG. 1 shows one embodiment of the control system in conformity with the invention. A hydraulic circuit generally designated by the numeral 30 comprises a hydraulic pump 1, a relief valve 2, a control valve 3, which may be an electrically or hydraulically operated servovalve, for controlling the flow rate and direction of a hydraulic fluid, an actuator 4 which may be a cylinder, and externally operated on-off valves **5*a* and 5*b* located in hydraulic lines 30*a*, 30*b*, 30*c*, 30*d* between the control valve 3 and the actuator 4 for allowing and blocking a flow of hydraulic fluid therebetween. The on-off valves 5*a* and 5*b* may be pilot-operated check valves. The control system 32 for the hydraulic circuit 30 comprises a pilot valve 6 for switching a pilot pressure for operating the on-off valves 5*a* and 5*b*, pressure sensors 7 and 8 connected to the hydraulic line 30*a* on the inlet port side of the on-off valve 5*a* and to the hydraulic line 30*b* on the outlet port side thereof, respectively, pressure sensors 9 and 10 connected to the hydraulic line 30*c* on the inlet port side of the on-off valve 5*b* and to the hydraulic line 30*d* on the outlet port side thereof, respectively, an operation lever 11, an operation sensor 11A for detecting an operation of the operation lever 11, and a control unit 12. The control unit 12 is operative to output an ON signal or an OFF signal to the pilot valve 6 and output an electric current 1 to the control valve 3, depending on the operation of the operation lever 11 and the values of pressures detected by the pressure sensors 7–10. The numeral 13** designates a hydraulic reservoir.

Figure 2:
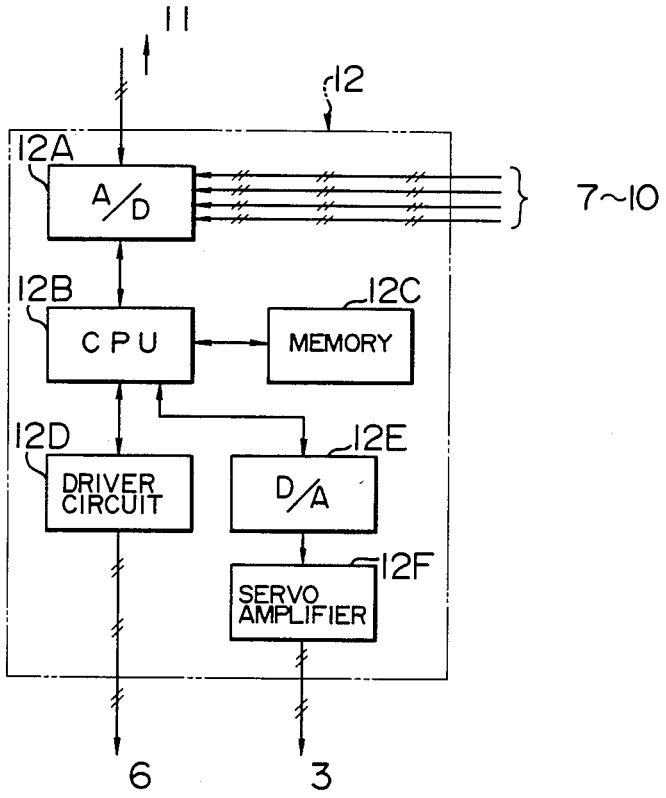
FIG. 2 is a circuit diagram of the control unit of the control system shown in FIG. 1, showing the structure of the control unit.

Referring to FIG. 2, the control unit 12 is composed of digital arithmetic and logic units and analog circuits and comprises an A/D converter 12A for converting an analog signal to a digital signal, a central processor unit (CPU) 12B for performing various arithmetic and logical operations, a memory 12C storing various control programs and predetermined functional relations, a driver circuit 12D for outputting the contents of control to the pilot valve 6, a D/A converter 12E for converting to an analog signal a digital signal which is an output of the contents of control, and a servo amplifier 12F for converting a voltage signal to a current signal and outputting same to the control valve 3.

The operation of the embodiment of the control system 32 shown in FIG. 1 and described hereinabove will be described by referring to a flow chart shown in FIG. 3. In step 40, an operation $X_L$ of the operation lever 11, an inlet port pressure $P_A$ of the on-off valve 5a sensed by the pressure sensor 7, an outlet port pressure $P_H$ of the on-off valve 5a sensed by the pressure sensor 8, an inlet port pressure $P_B$ of the on-off valve 5b sensed by the pressure sensor 9, and an outlet port pressure $P_R$ of the on-off valve 5b sensed by the pressure sensor 10 are loaded into the CPU 12B through the A/D converter 12A. Then, in step 41, it is determined by the CPU 12B whether or not the operation lever 11 has been operated or the operation $X_L$ has exceeded a control valve current command value $X=0$. When it is determined that the operation lever 11 has not been operated, the process shifts to step 42 in which an OFF signal is supplied from the CPU 12B to the pilot valve 6 through the driver circuit 12D to bring the pilot valve to a closed position. This keeps the on-off valves 5a and 5b in closed positions as shown in FIG. 1. Besides bringing the pilot valve 6 to the closed position, the OFF signal is stored in the memory 12C in step 42. Then, in step 43, the CPU 12B issues a command to the memory 12C to set the control valve current command value X at 0.

When it is determined in step 41 that the operation lever 11 has been operated, the process shifts to step 44 in which it is determined based on information obtained in step 42 and in step 46 subsequently to be described whether or not the pilot valve 6 is turned ON. When it is determined that the pilot valve 6 is not turned ON, the process shifts to step 45 in which pressure matching control is performed to reduce the difference between the pressures upstream and downstream of the on-off valves 5a and 5b. The details of the pressure matching control are subsequently to be described. When step 45 has been followed, the process shifts to step 46. When it is determined in step 44 referred to hereinabove that the pilot valve 6 is turned ON, the process also shifts to step 46.

In step 46, an ON signal is supplied from the CPU 12B to the pilot valve 6 through the driver circuit 12D. This switches the pilot valve 6 from the position shown in FIG. 1 and brings the on-off valves 5a and 5b to an open position. In step 46, the ON signal turning ON the pilot valve 6 is stored in the memory 12C. Then, in step 47, the CPU 12B selects a specific value $X_o$ corresponding to the operation $X_L$ of the operation lever 11 based on the functional relation between the operation $X_L$ and the control valve current command value X stored in the memory 12C, and $X=X_o$ is stored in the memory 12C. Following steps 43 and 47, the process shifts to step 48 in which the CPU 12B outputs the control valve current command value X to the D/A converter 12E. Then, in step 49, the control valve current command value X which is a digital signal is converted to an analog voltage signal V by the D/A converter 12E and the voltage signal V is converted to a current signal I by the servo amplifier 12F, and the servo current I is passed to the control valve 3, which controls the flow rate and direction of the hydraulic fluid flowing therethrough in accordance with the servo current I.

Figure 3:
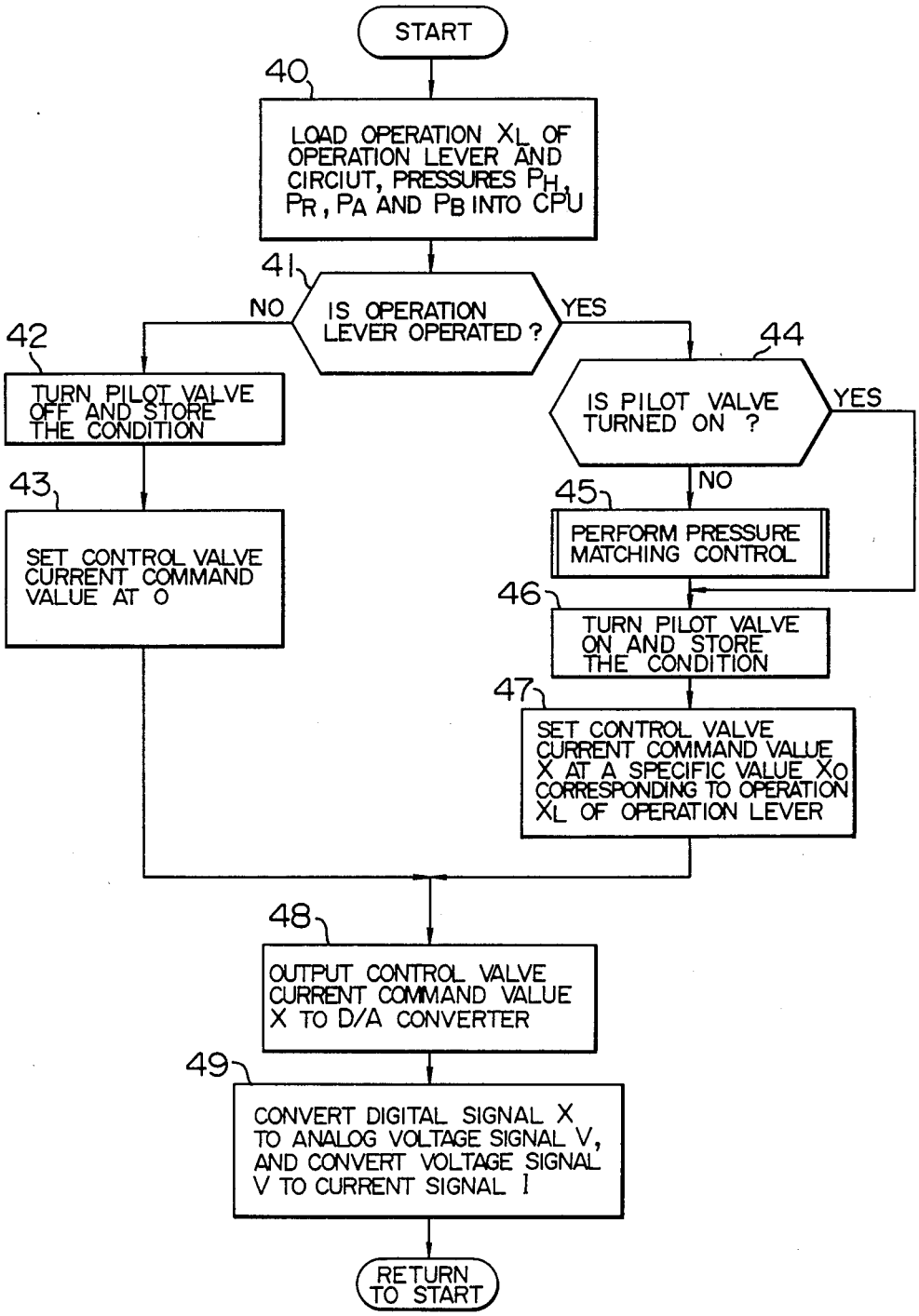
FIG. 3 is a flow chart of a first manner of operation of the control system according to the invention.
Figure 4:
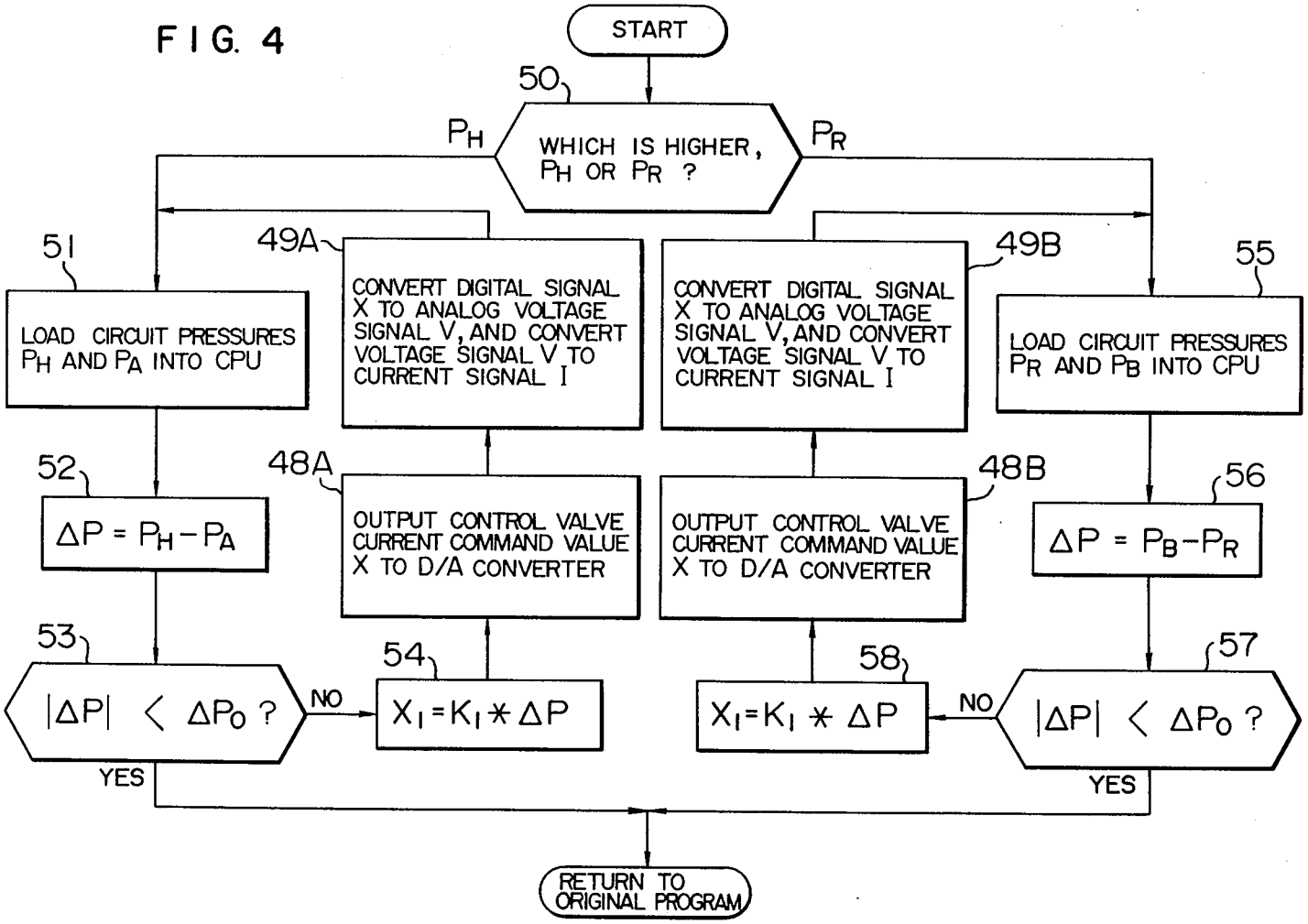
FIG. 4 is a flow chart of a first series of procedures followed when pressure matching control is performed in the operation of the control system shown in FIG. 3.

FIG. 4 is a flow chart of a first series of procedures followed when pressure matching control is performed in the operation of the control system shown in FIG. 3. In this series of procedures, the difference between the pressures upstream and downstream of the on-off valve is reduced in one of the on-off valves 5a and 5b in which the outlet port pressure $P_H$ or $P_R$ is higher. This operation is performed based on the fact that, since the inlet port pressures $P_A$ and $P_B$ of the on-off valves 5a and 5b are equal to each other when no current is passed to the control valve 3, the difference between the pressures upstream and downstream of the valve is naturally larger in one of the on-off valves 5a and 5b in which the outlet port pressure $P_H$ or $P_R$ is higher. It will be seen that an impact of shock applied to the actuator 4 when the on-off valves 5a and 5b are switched from a closed position to an open position can be lessened merely by reducing the difference between the pressures upstream and downstream of the on-off valve 5a or 5b in which the pressure difference is greater.

More specifically, in the operation shown in FIG. 4, it is determined in step 50 which of the outlet port pressures $P_H$ and $P_R$ of the on-off valves 5a and 5b is higher. When the outlet port pressure $P_H$ of the on-off valve 5a is determined to be higher, the process shifts to step 51 in which the pressures $P_H$ and $P_A$ are loaded into the CPU 12B through the A/D converter 12A. Then, in step 52, the CPU 12B calculates the difference between the pressures $P_H$ and $P_A$ and a value $\Delta P$ of the difference is stored in the memory 12C. Then, the process shifts to step 53 in which it is determined by the CPU 12B whether or not an absolute value $|\Delta P|$ of the pressure difference $\Delta P$ is smaller than a first value $\Delta P_o$ for determining completion of pressure matching control stored beforehand in the memory 12C or whether or not the difference between the inlet port pressure PA and the outlet port pressure $P_H$ of the on-off valve 5a is smaller than the predetermined value $\Delta P_o$. When it is determined that the pressure difference $|\Delta P|$ is smaller than the determining value $\Delta P_o$, the process leaves the operation of the pressure matching control and returns to the original program. However, when it is determined in step 53 that the pressure difference $|\Delta A|$ is larger than the determining value $\Delta P_o$, the process shifts to step 54 in which the pressure difference $\Delta P$ stored in the memory 12C is multiplied by a predetermined coefficient $K_1$ in the CPU 12B and a value $X_1$ obtained by the multiplication is used as the control valve current command value X. Then, the process shifts to steps 48A and 49A similar to steps 48 and 49 shown in FIG. 3, in which a current I corresponding to the value $X_1$ obtained by the multiplication is passed to the control valve 3. Here, if a positive current is passed to the control valve 3, then the control valve 3 is actuated to allow the hydraulic fluid to flow to the hydraulic lines 30a, 30b to which the on-off valve 5a is connected; if a negative current is passed to the control valve 3, then the control valve 3 is actuated to allow the hydraulic fluid to flow to the hydraulic lines 30c, 30d to which the on-off valve 5b is connected. The process returns from step 49A to step 51 in which the pressures $P_H$ and $P_A$ are loaded into the CPU 12B again. By repeatedly following the steps 51~48A and 49A, the difference between the pressures upstream and downstream of the on-off valve 5a is reduced.

When it is determined in step 50 that the outlet port pressure $P_R$ of the on-off valve 5b is higher, the process shifts to step 55, and steps 55~58, 48B and 49B similar to the steps 51~54, 48A and 49A are followed with regard to the on-off valve 5b to thereby reduce the difference between the pressures upstream and downstream of the on-off valve 5b.

Figure 5:
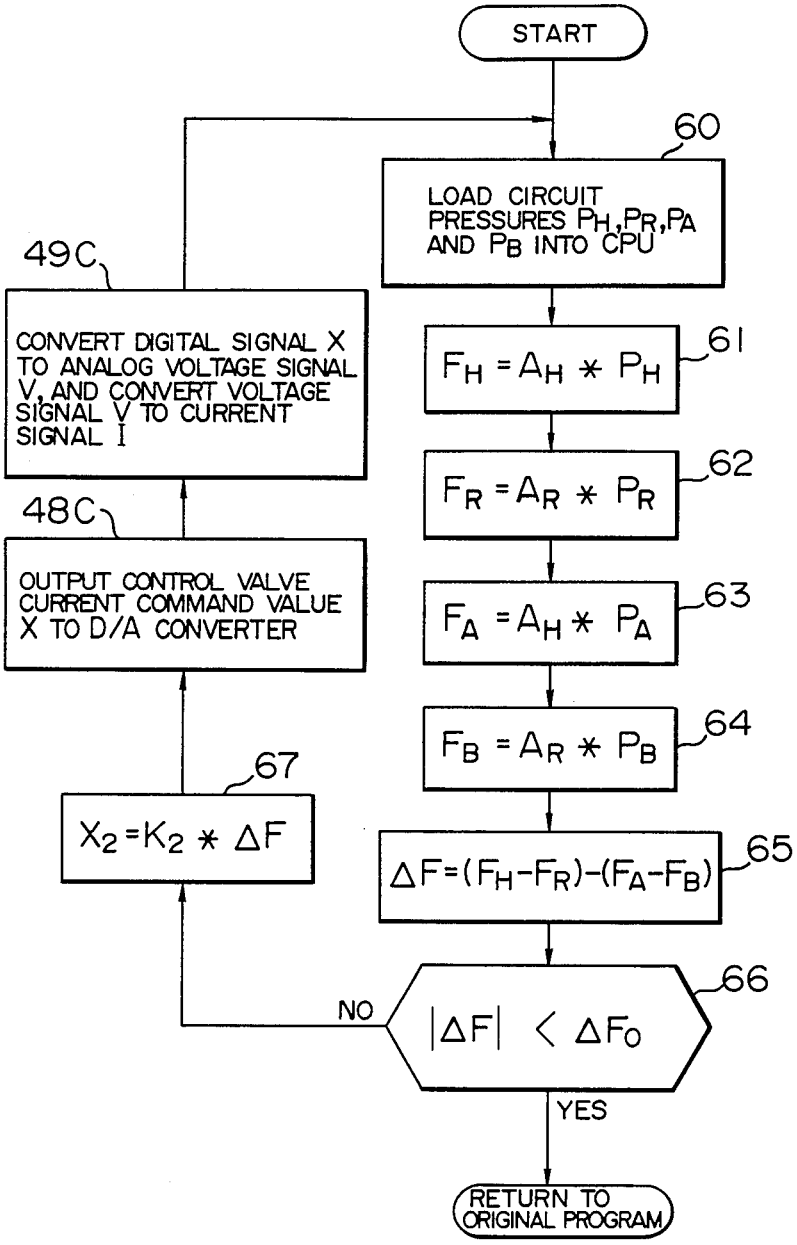
FIG. 5 is a flow chart of a second series of procedures followed when pressure matching control is performed in the operation of the control system shown in FIG. 3.

FIG. 5 is a flow chart of a second series of procedures followed when pressure matching control is performed in the operation of the control system shown in FIG. 3. In this series of procedures, the inlet port pressures $P_A$ and $P_B$ of the on-off valves 5a and 5b are controlled such that they become equivalent to a thrust applied to the actuator or cylinder 4 placed in a condition shown in FIG. 1. The thrust f being applied to the cylinder 4 can be obtained by the following equation:

$$f=A_H \cdot P_H - A_R \cdot P_R$$

where $A_H$ is the effective area on the head side of the cylinder 4 and $A_R$ is the effective area on the rod side of the cylinder 4.

By effecting this control, it is possible to minimize an impact of shock because the thrust applied to the cylinder 4 undergoes no sudden change when the on-off valves 5a and 5b are switched from a closed position to an open position.

Morespecifically, in step 60, the pressures $P_H$, $P_R$, $P_A$ and $P_B$ are loaded into the CPU 12B through the A/D converter 12A. Then, in step 61, a force exerted on the head side of the cylinder 4 is calculated by multiplying the outlet port pressure $P_H$ of the on-off valve 5a by the head side area $A_H$ of the cylinder 4. A value $F_R$ of the force obtained is stored in the memory 12C. Then, the process shifts to step 62 in which an operation is performed on $F_R=A_R*P_R$ to calculate a force exerted on the rod side of the cylinder 4, and the value $F_R$ of the force is stored in the memory 12C. Then, in step 63, an operation is performed on $F_A=A_H*P_A$ and the value $F_A$ obtained is stored in the memory 12C. Likewise, an operation is performed on $F_B=A_R*P_R$ in step 64 and the value $F_B$ obtained is stored in the memory 12C. Then, in step 65, the difference $\Delta F$ between the actual thrust being applied to the cylinder 4 and the thrust obtained by calculating the inlet port pressures $P_A$ and $P_B$ of the on-off valves 5a and 5b is calculated and stored in the memory 12C. Then, the process shifts to step 66 in which it is determined by the CPU 12B whether or not an absolute value $|\Delta F|$ of the thrust differential $A_F$ is smaller than a second value $\Delta F_o$ for determining completion of pressure matching control stored beforehand in the memory 12C. If it is determined that the thrust difference $|\Delta F|$ is smaller than the predetermined value $\Delta F_o$, then the process returns to the original program. If it is determined in step 66 that the thrust differential $|\Delta F|$ is greater than the value $\Delta F_o$, then the process shifts to step 67 in which the thrust difference $\Delta F$ stored in the memory 12C is multiplied by a predetermined coefficient $K_2$ in the CPU 12B to obtain a value $X_2$ which is used as the control valve current command value X. Then, steps 48C and 49C similar to the steps 48 and 49 shown in FIG. 3 are followed, so that the electric current I corresponding to the value $X_2$ obtained by calculation is passed to the control valve 3. By repeatedly following the steps 60~67, 48C and 49C, the inlet port pressures $P_A$ and $P_B$ of the on-off valves 5a and 5b can be made to come near levels equivalent to the thrust f being applied to the cylinder 4.

The invention thus reduces an impact of shock applied to the cylinder 4 when the on-off valves 5a and 5b are switched from a closed position to an open position, thereby enabling acceleration of the load to be achieved smoothly.

A second manner of operation of the control system according to the invention will be described by referring to a flow chart shown in FIG. 6.

First of all, in step 70, the operation $X_L$ of the operation lever 11, the inlet port pressure $P_A$ of the on-off valve 5a sensed by the pressure sensor 7, the outlet port pressure $P_H$ of the on-off valve 5a sensed by the pressure sensor 8, the inlet port pressure $P_B$ of the on-off valve 5b sensed by the pressure sensor 9, and the outlet port pressure $P_R$ of the on-off valve 5b sensed by the pressure sensor 10 are loaded into the CPU 12B through the A/D converter 12A. Then, in step 71, it is determined by the CPU 12B whether or not the operation lever 11 is operated or the operation $X_L$ has exceeded the servo current command value $X=0$. When it is determined that the operation lever 11 is not operated, the process shifts to step 72 in which an OFF signal is supplied from the CPU 12B to the pilot valve 6 through the driver circuit 12D. This keeps the on-off valves 5a and 5b in a closed position as shown in FIG. 1.

Then, the process shifts to step 73 in which pressure matching control is performed to reduce the difference between the pressures upstream and downstream of the on-off valves 5a and 5b. The details of the pressure matching control are subsequently to be described.

When it is determined in step 71 that the operation lever 11 is operated, the process shifts to step 74 in which an ON signal is supplied from the CPU 12B to the pilot valve 6 through the driver circuit 12D. This switches the pilot valve 6 from a right position shown in FIG. 1 to a left position to thereby actuate the on-off valves 5a and 5b to an open position.

Then, in step 75, the CPU 12B selects a specific value $X_o$ corresponding to the operation $X_L$ of the operation lever 11 based on the functional relation between the operation $X_L$ and the control valve current command value X stored in the memory 12C, and $X=X_o$ is stored in the memory 12C. The process shifts from steps 73 and 75 to step 76 in which the control valve current command value X is outputted from the CPU 12B to the D/A converter 12E. Then, in step 77, the control valve current command value X which is a digital signal is converted to an analog voltage signal V by the D/A converter 12E, and the analog voltage signal V is converted by the servo amplifier 12F to a current signal I, which is supplied as a servo current to the control valve 3. The control valve 3 controls the flow rate and direction of the hydraulic fluid flowing therethrough in accordance with the servo current I.

Figure 6:
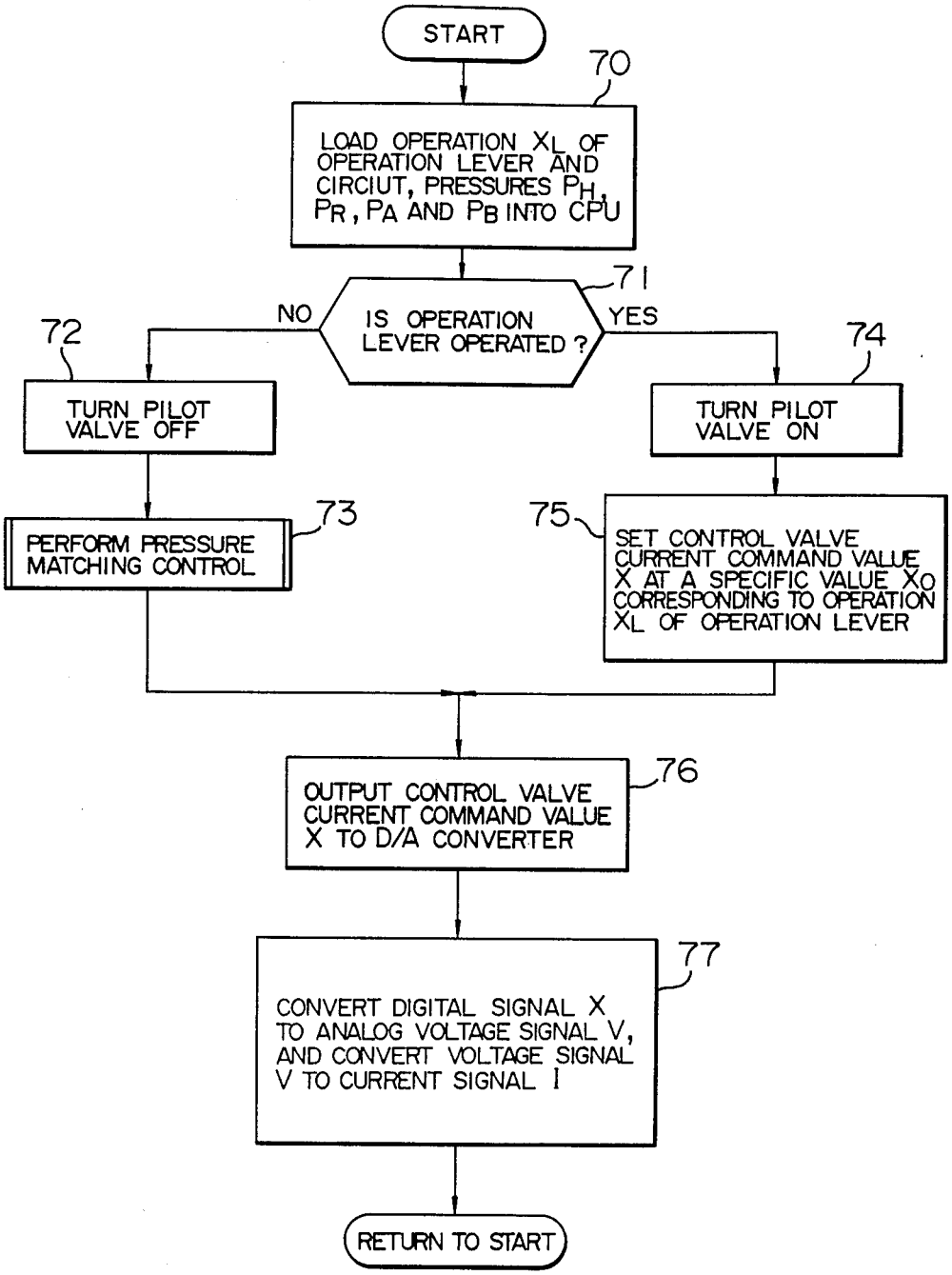
FIG. 6 is a flow chart of a second manner of operation of the control system according to the invention.
Figure 7:
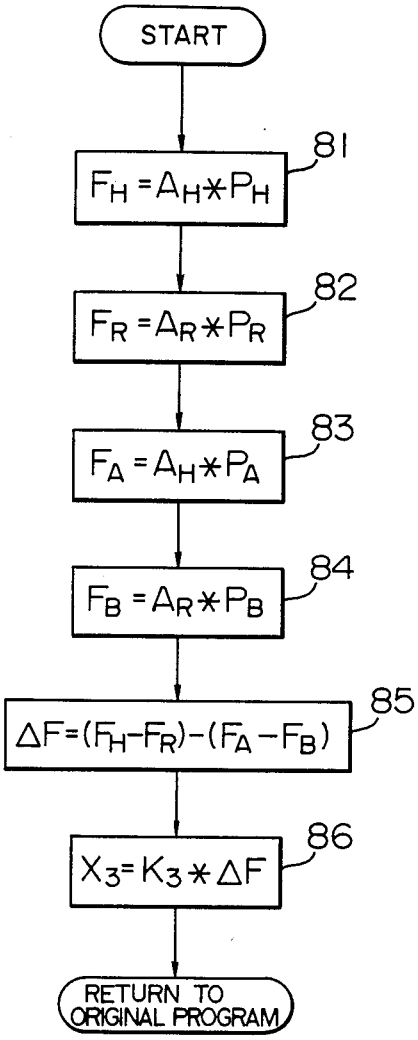
FIG. 7 is a flow chart of a series of procedures followed when pressure matching control is performed in the operation of the control system shown in FIG. 6.

FIG. 7 is a flow chart of a series of procedures followed when pressure matching control is performed in the operation of the control system shown in FIG. 6. Like the procedures shown in FIG. 5, the procedures shown in FIG. 7 are followed in performing pressure matching control by controlling the inlet port pressures $P_A$ and $P_B$ of the on-off valves 5a and 5b to bring them to levels equivalent to the thrust being applied to the cylinder 4 placed in a condition shown in FIG. 1.

More specifically, the pressures $p_H$, $P_R$, $P_A$ and $P_B$ have already been loaded into the CPU 12B through the A/D converter 12A in step 70 shown in FIG. 6. In step 81, the outlet port pressure $P_H$ of the on-off valve 5a is multiplied by the head side effective area $A_H$ of the cylinder 4 or an operation is performed on $F_H=A_H*P_H$ to calculate a force $F_H$ exerted on the head of the cylinder 4. The value of $F_E$ obtained by calculation is stored in the memory 12C. Then, the process shifts to step 82 in which the outlet port pressure $P_R$ of the on-off valve 5b is multiplied by the rod side effective area $A_R$ of the cylinder 4 or an operation is performed on $F_R=A_R*P_B$ to calculate a force $F_R$ exerted on the rod of the cylinder 4. The value of $F_R$ obtained by calculation is stored in the memory 12C. Then, in step 83, an operation is performed on $F_A=A_H*P_A$ and the value of $F_A$ obtained by calculation is stored in the memory 12C. In step 84, an operation is performed on $F_B=A_B*P_B$ and the value of $F_B$ obtained by calculation is also stored in the memory 12C. In step 85, the difference $\Delta F$ between the actual thrust $F_H$-$F_R$ being applied to the cylinder 4 and the thrust $F_A$-$F_B$ obtained by calculation based on the inlet port pressures $P_A$ and $P_B$ of the on-off valves 5a and 5b is calculated and stored in the memory 12C. The process shifts to step 86 in which th difference $\Delta F$ in thrust stored in the memory 12C is multiplied by a predetermined coefficient $K_3$, and a value $X_3$ obtained by calculation is used as the control valve current command value X. Then, the process leaves the pressure matching control and returns to the original program to follow steps 76 and 77 shown in FIG. 6. Thus, the current X corresponding to the value $X_3$ obtained by calculation is passed to the control valve 3. By repeatedly following the steps 70~72, 73 (81~86), 76 and 77, it is possible to let the inlet port pressures $P_A$ and $P_B$ of the on-off valves 5a and 5b come near levels equivalent to the thrust f being applied to the cylinder 4.

As described hereinabove, the invention minimizes an impact of shock applied to the cylinder 4 when the on-off valves 5a and 5b are switched from a closed position to an open position, thereby allowing the load to be smoothly accelerated. In the invention, pressure matching control is effected when no operation signal is outputted. This permits control to be effected based on the operation signal as soon as it is outputted, thereby improving the operability of the equipment.

Figure 8:
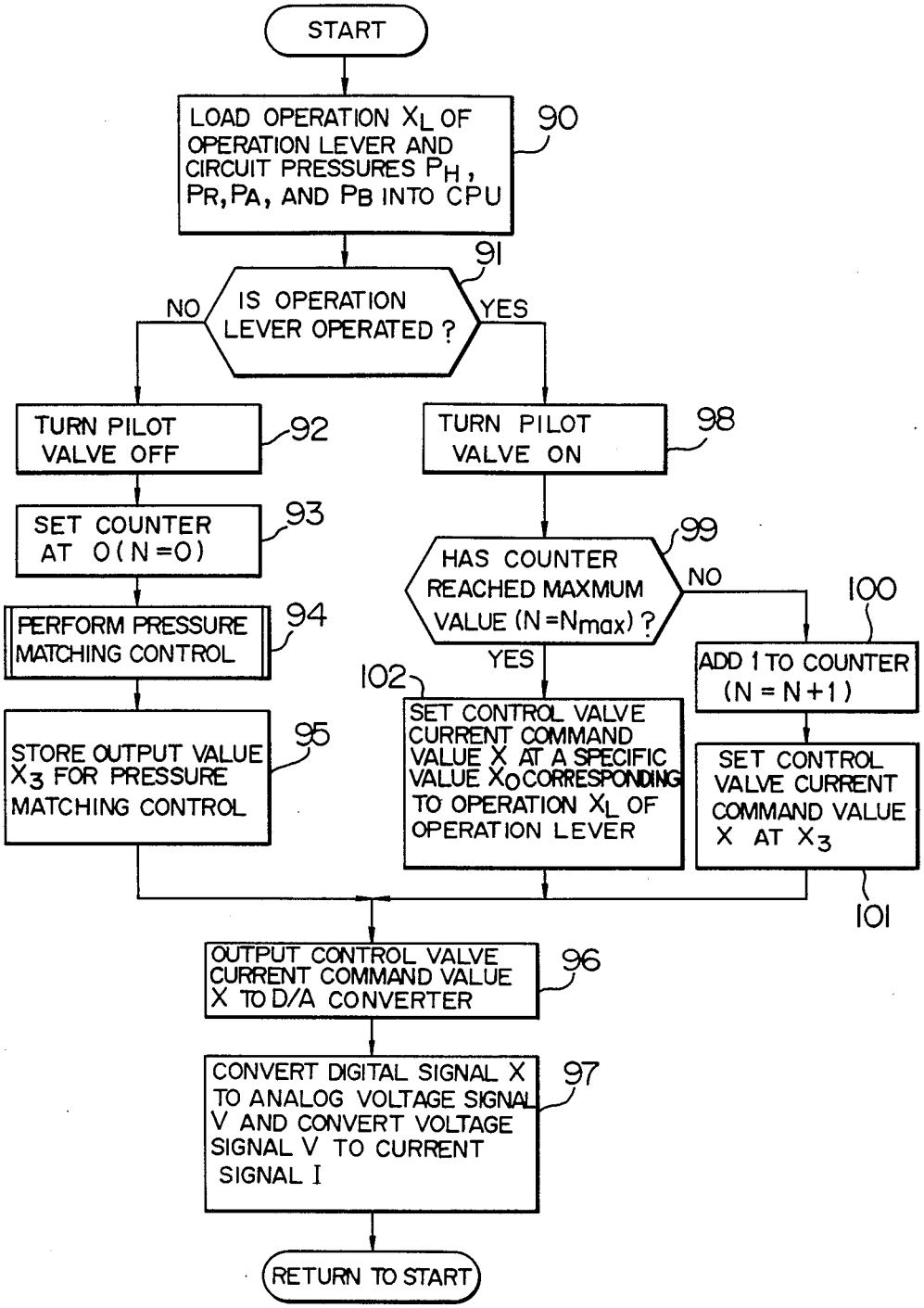
FIG. 8 is a flow chart of a third manner of operation of the control system according to the invention.

FIG. 8 shows a flow chart of a third manner of operation of the control system according to the invention.

In step 90, the operation $X_L$ of the operation lever 11, the inlet port pressure $P_A$ of the on-off valve 5a sensed by the pressure sensor 7, the outlet port pressure $P_H$ of the on-off valve 5a sensed by the pressure sensor 8, the inlet port pressure $P_B$ of the on-off valve 5b sensed by the pressure sensor 9 and the outlet port pressure $P_R$ sensed by the pressure sensor 10 are loaded into the CPU 12B through the A/D converter 12A. Then, in step 91, it is determined by the CPU 12B whether or not the operation lever 11 is operated or whether or not the operation $X_L$ has exceeded a control valve current command value X=0. When it is determined that the operation lever 11 is not operated, the process shifts to step 92 in which an OFF signal is supplied from the CPU 12B to the pilot valve 6 through the driver circuit 12D. This keeps the on-off valves 5a and 5b in a closed position as shown in FIG. 1. Then, the process shifts to step 93 in which a counter is set at 0. The process shifts to step 94 in which pressure matching control is performed to reduce the difference between the pressures upsteam and downstream of the on-off valves 5a and 5b. The pressure matching control performed in step 94 is the same as that explained with reference to FIG. 7 in respect of the second manner of operation of the control system according to the invention, so that the description of the details of such control will be omitted.

In step 95, the output $X_3$ for the pressure matching control in step 94 is stored in the memory 12C.

Then, the process shifts to step 96 in which the control valve current command value X is outputted from the CPU 12B to the D/A converter 12E. In step 97, the control valve current command value X which is a digital signal is converted by the D/A converter 12E to a analog voltage signal V which is converted by the servo amplifier 12F to a current signal I. The current signal I is passed to the control valve 3 which controls the flow rate and direction of the hydraulic fluid flowing therethrough in accordance with the servo current I.

When the operation lever 11 is not operated, the steps 90~97 described hereinabove are repeatedly followed, and in step 95 the last value of the output $X_3$ of the CPU 12B is stored each time pressure matching control is performed.

If it is determined in step 91 that the operation lever 11 is operated, then the process shifts to step 98 in which an ON signal is supplied from the CPU 12B to the pilot valve 6 through the driver circuit 12D.

This causes the pilot valve 6 to be switched from a right position shown in FIG. 1 to a left position. It should be noted, however, that there is a dead time of switching or a transient period of from the time the ON signal is produced to the time the on-off valves 5a and 5b are completely opened. Thus, during the transient period, the pilot valve 6 is not switched completely from the right position to the left position and the on-off valves 4a and 4b remain closed.

Then, the process shifts to step 99 in which it is determined whether or not the value of the counter has reached a maximum value $N_{max}$. As described hereinabove, the counter was set at 0 in step 93 and its value is not naturally maximized, so that the process shifts to step 100 in which 1 is added to the value of the counter. In step 101, the control valve current command value X is set at the last value of the output $X_3$ obtained in step 95 for the pressure matching control. In steps 96 and 97, the current I corresponding to the last value of the output $X_3$ for the pressure matching control is passed to the control valve 3.

The steps 90, 91, 98~101, 95 and 97 are repeatedly followed until the value of the counter reaches the maximum value $N_{max}$. While these steps are being repeatedly followed, the pilot valve 6 is completely switched from the right position to the left position in FIG. 1 and the on-off valves 5a and 5b are switched from the closed position to the open position. That is, the maximum value $N_{max}$ of the counter is set at a value such that $N_{max} * \Delta T$ ($\Delta T$: sampling time of the program) is greater than the dead time or transient period involved in switching of the pilot valve 6 and on-off valves 5a and 5b.

The steps 93, 95 and 99~101 described hereinabove are referred to as output holding control steps.

When the value of the counter has reached the maximum value $N_{max}$, the process shifts to step 92 in which a specific value $X_o$ corresponding to the operation $X_L$ of the operation lever 11 is selected from the functional relation between the operation $X_L$ and the control valve current command value X, and $X=X_o$ is stored in the memory 12C. Then, the process shifts to steps 96 and 97.

By following the steps 90, 91 and 98~102 as described hereinabove, it is possible to let a value corresponding to the operation of the lever 11 be outputted to the control valve 3 only after the on-off valves 5a and 5*b* are completely opened. This avoids a risk that the load might be suddenly accelerated with a jerk.

From the foregoing description, it will be appreciated that the present invention minimizes an impact of shock which would be applied to the actuator when the on-off valves are switched from a closed position to an open position, thereby permitting the load to be accelerated smoothly. Also, the output of the CPU produced in the pressure matching control is held during the dead time of switching or the transient period from the time an instruction is given to open the on-off valves to the time the on-off valves are actually opened. This is conductive to the prevention of sudden acceleration of the load with a jerk.

In the embodiment of the invention shown in FIG. 1, the control unit 12 has been described as being composed of a digital arithmetic and logic units and analog circuits. However, the invention is not limited to this specific form of the control unit 12 and the control unit 12 may entirely be composed of analog circuits.

The externally operated on-off valves 5*a* and 5*b* have been described as being hydraulically controlled by the pilot valve 6. However, the on-off valves 5*a* and 5*b* may be controlled by an electrical signal or pneumatic pressure in operation.

What is claimed is:

1. A control system for a hydraulic circuit having on-off valves interposed by means of hydraulic lines between a control valve and an actuator for allowing and blocking a flow of hydraulic fluid therebetween, so that when the on-off valves are closed, a pressure differential exists in the hydraulic lines upstream and downstream of the on-off valves whereby a thrust is produced on the actuator when switching the on-off valves to an open position, operation means for providing a signal to actuate and switch the control valve and on-off valves, pressure sensor means connected to the hydraulic lines upstream and downstream of the on-off valves for detecting the pressure in these hydraulic lines; and control means for calculating, based on the pressures detected by the pressure sensor means, a value representative of reduction of the thrust applied to the actuator and outputting the calculated value to the control valve while the on-off valves are closed to thereby perform pressure matching control for reducing the thrust.

2. A control system as claimed in claim 1, wherein said control means is operative, when the operation means has been operated, to output the calculated value before outputting a value corresponding to the operation of the operation means to the control valve to perform the pressure matching control and then open the on-off valves and output the valve corresponding to the operation to the control valve.

3. A control system as claimed in claim 1, wherein said control means is operative to determine which of two pressures in the hydraulic lines located on the side of the actuator is higher and calculate, as the value representative of reduction of the thrust, a value which reduces the pressure differential upstream and downstream of the on-off valve connected to the hydraulic line in which the pressure is determined to be higher, to thereby perform the pressure matching control.

4. A control system as claimed in claim 1, wherein said control means is operative to calculate actual thrusts applied to the actuator based on two pressures in the hydraulic lines located on the side of the actuator and calculate, as the value representative of reduction of the thrust, a value which causes two pressures in the hydraulic lines located on the side of the control valve to become equivalent to the calculated actual thrusts to thereby perform the pressure matching control.

5. A control system as claimed in claim 1, wherein said control means is operative, when no operation signal is outputted by said operation means, to calculate, based on the pressures detected by the pressure sensor means the value representative of reduction of the thrust and output the calculated value to the control valve to perform the pressure matching control, and when the operation signal has been outputted by said operation means, to open the on-off valves and output a valve corresponding to the operation of the operation means to the control value.

6. A control system as claimed in claim 5, wherein said control means is operative to hold the output valve for the pressure matching control during a transient period of from the time an instruction is given to open the on-off valves to the time the on-off valves are actually opened and output the value corresponding to the operation of the operation means to the control valve.

7. A control system as claimed in claim 6, wherein said control means is operative to set a maximum value for a counter such that a value obtained by multiplying the maximum value by a sampling time is greater than the transient period, output the calculated value for the pressure matching control to the control valve before the value of the counter reaches the maximum value and output the value corresponding to the operation of the operation means to the control valve after the value of the counter has reached the maximum value.

* * * * *